United States Patent [19]

Swieskowski

[11] 4,355,563

[45] Oct. 26, 1982

[54] DUAL RATE FIRING MECHANISM

[75] Inventor: Henry P. Swieskowski, Sparta, N.J.

[73] Assignee: The United States of America as represented by the Secretary of the Army, Washington, D.C.

[21] Appl. No.: 163,372

[22] Filed: Jun. 26, 1980

[51] Int. Cl.[3] ..... F41D 11/12

[52] U.S. Cl. ..... 89/130

[58] Field of Search ..... 89/129 R, 130, 199

[56] References Cited

U.S. PATENT DOCUMENTS 2,389,095 11/1945 Vesely ..... 89/129 R

*Primary Examiner*—Stephen C. Bentley

*Attorney, Agent, or Firm*—Nathan Edelberg; Robert P. Gibson; Harold H. Card, Jr.

[57] ABSTRACT

A dual rate of fire mechanism in an automatic weapon absorbs and dissipates a portion of the recoil energy to produce a slow firing rate and inactivates the energy absorbing elements to produce a rapid firing rate. Compression of a recoil spring stores the recoil energy of the weapon bolt and normally returns substantially all of the energy to the bolt in a counter recoil portion of the cycle. In slow firing mode, some of the energy stored in the recoil spring is dissipated in a positioning spring thus providing less energy to the counter recoil action and slowing the rate at which succeeding rounds are fired.

6 Claims, 5 Drawing Figures

DUAL RATE FIRING MECHANISM

The invention described herein may be manufactured, used and licensed by or for the Government for governmental purposes without the payment to me of any royalties thereon.

BACKGROUND OF THE INVENTION

This invention relates to automatic weapons and more particularly to automatic weapons having a plurality of firing rates.

In automatic weapons, it is desirable to have a plurality, for example 2, firing rates. Such multiple firing rates have been accomplished employing delay mechanisms which require additional parts and thus increase the complexity and cost of the apparatus. Such delay mechanisms are found, for example, in the M85 machine gun.

OBJECTS AND SUMMARY OF THE INVENTION

It is an object of the present invention to provide a dual-rate firing mechanism for an automatic weapon.

It is further object of the invention to provide a dual-rate firing mechanism for an automatic weapon which requires a minimum of parts and is economical to manufacture.

According to an aspect of the invention, there is provided a dual-rate firing mechanism for an automatic weapon of the type having a bolt driven in a recoil action and returned in a counter recoil action comprising means for storing energy of the bolt during the recoil action and for returning at least part of the stored energy to the bolt during the counter recoil action, and means for selectively dissipating a portion of the stored energy during the recoil action whereby less than substantially all of the stored energy remains for return to the bolt during the counter recoil action.

According to a feature of the invention, there is provided a method for reducing rate of fire in an automatic weapon of the type having a bolt driven in a recoil action and returned in a counter recoil action comprising storing kinetic energy of the bolt in the recoil action as a spring potential energy, and applying at least a portion of the spring potential energy to compress a second spring before the end of the counter recoil action whereby a portion of the spring potential energy is dissipated in compressing the second spring.

According to another aspect of the invention, there is provided a dual-rate firing mechanism for an automatic weapon comprising a housing having first and second ends, an abutment at the first end of the housing, a plunger protruding from the second end of the housing, a bolt to which kinetic energy is imparted by firing the automatic weapon, the kinetic energy being effective to impact the bolt upon the plunger and to tend to drive the plunger into the housing, a recoil spring in the housing having a first end in abutment with the plunger, a positioning spring having a first end in contact with the abutment, a second end of the recoil spring and a second end of the positioning spring being mutually opposed, the recoil spring and the positioning spring being normally equally preloaded by the opposition therebetween, a sear having first and second positions, the sear being effective when in its first position to hold the second end of the recoil spring stationary during at least part of driving the plunger by the bolt whereby the kinetic energy of the bolt is transformed into spring potential energy of the recoil spring, the sear being effective when in its second position to release the second end of the recoil spring whereby equilibrium between opposing forces in the recoil spring and the positioning spring is attained, and means for moving the sear from its first position to its second position at a predetermined time after the bolt begins driving the plunger.

The above, and other objects, features and advantages of the present invention, will become apparent from the following description read in conjunction with the accompanying drawings, in which like reference numerals designate the same elements.

DETAILED DESCRIPTION OF THE PREFERRED EMBODIMENTS

Figure 1:
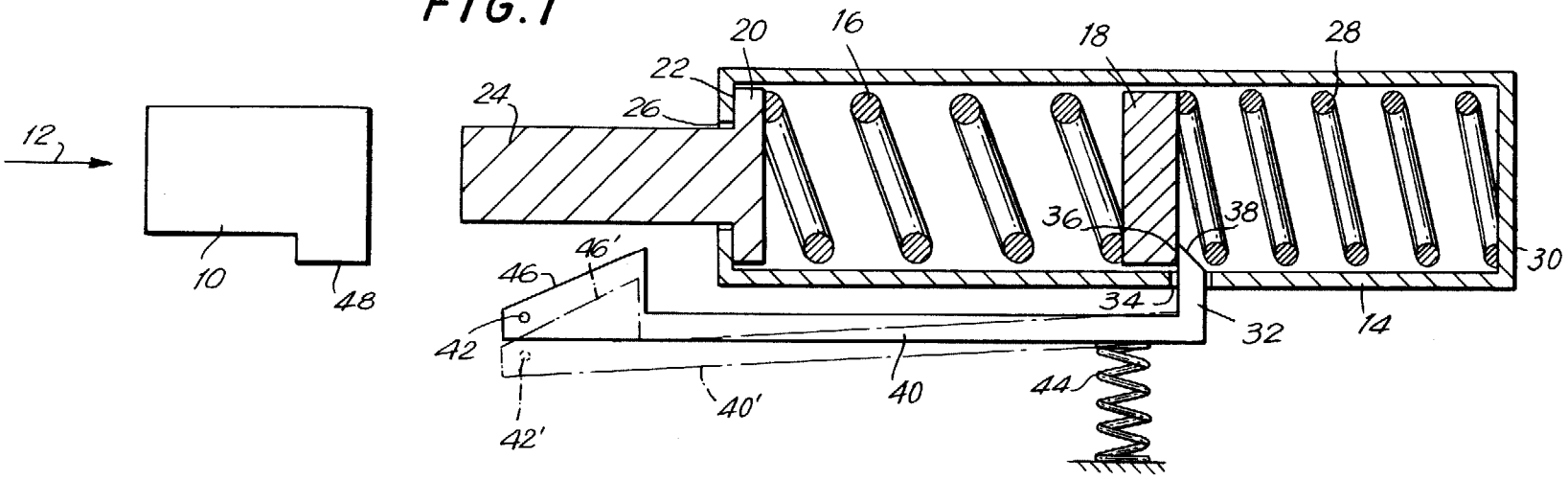
FIG. 1 is a cross sectional view of a dual rate firing mechanism for an automatic weapon according to the present invention.

Referring to FIG. 1, a bolt 10 of an automatic weapon is driven rearward in the recoil direction as shown by an arrow 12 following the firing of a round. A housing 14 contains a recoil spring 16 biased between a mass 18 and a disc 20 and engages an engagement shoulder 22 at the end of housing 14. A plunger rod 24, which may optionally be integral with disc 20, extends through an opening 26 centered in engagement shoulder 22.

A positioning spring 28 is biased between mass 18 and an end abutment 30 of housing 14.

A sear 32 passes through an access opening 34 in housing 14 and a latching surface 36 thereof is disposed adjacent to the surface of mass 18 which is remote from plunger rod 24. A sloping cam surface on sear 32 faces away from mass 18.

A bar 40 pivoted at a pivot 42 is urged in the counterclockwise direction in FIG. 1 by a sear return spring 44. Sear 32, preferably integral with bar 40, is urged into its latching position shown by the tendency of bar 40 to rotate in the counterclockwise direction.

Recoil spring 16 has a greater force constant than positioning spring 28 as shown by the relative diameters of the material thereof. However, recoil spring 16 and positioning spring 28 are equally preloaded such that mass 18 is normally returned to the position shown wherein sear 32 is enabled to move into its latching position. Although not shown, a small clearance may exist between the adjacent surfaces of mass 18 and latching surface 36.

A sloping cam surface 46 on bar 40 adjacent pivot 42 lies in the path of a cam actuating protuberance 48 on bolt 10 when the apparatus is adjusted for a low firing rate.

An alternative location for pivoting of bar 40 is shown at pivot 42' in a location sufficiently lower than pivot 42 so that cam surface 46', shown in dashed line, is lowered far enough that it is below the path of cam actuating protuberance 48. In the rapid fire position, sear 32 remains in the latching position shown by the dashed lines in FIG. 1 throughout the recoil travel of bolt 10 while the kinetic energy of bolt 10 is stored in recoil spring 16. Thereafter, the recoil energy stored in recoil spring 16 is returned to bolt 10 through plunger rod 24 in order to drive bolt 10 in the counter-recoil action. Except for minor unavoidable losses, substantially the entire recoil kinetic energy of bolt 10 is returned to bolt 10 during counter-recoil.

The following describes the action during low rate of fire wherein pivot 42 is used along with the solid line positions of cam surface 46 and bar 40.

Figure 2:
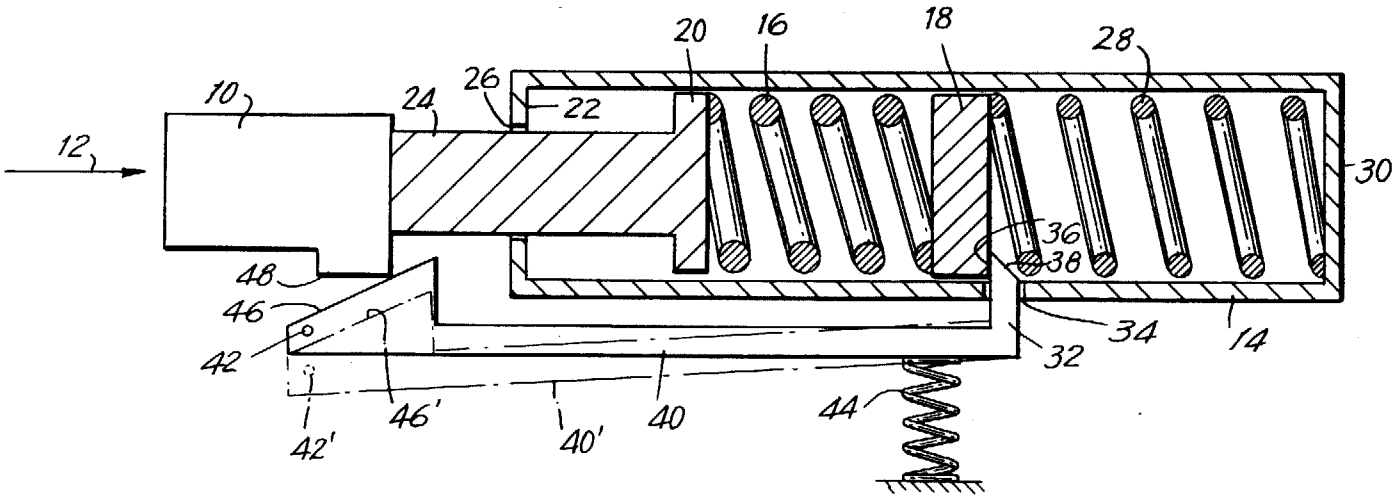
FIGS. 2–4 are views of the dual rate firing mechanism of FIG. 1 at different points in a firing cycle.

Referring now to FIG. 2, as bolt 10 continues its recoil travel in the direction of arrow 12, recoil energy is stored in recoil spring 16. At the instant shown in FIG. 2, cam actuating protuberance 48 has moved into contact with cam surface 46 but has not yet actuated sear 32.

Figure 3:
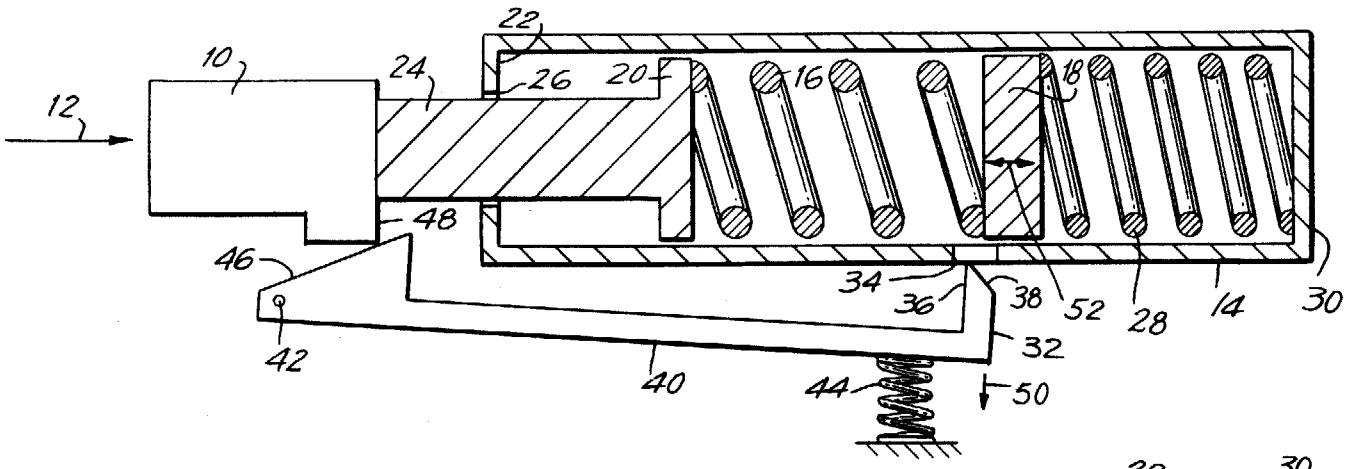

Referring now to FIG. 3, continued travel of bolt 10 and cam actuating protuberance 48, acting on cam surface 46, has rotated bar 40 in the clockwise direction as indicated by a curving arrow 50 and has disengaged latching surface 36 of sear 32 from mass 18. Mass 18 is thereby enabled to move toward the right in FIG. 3 whereby a portion of the energy stored in recoil spring 16 is transferred to positioning spring 28. In addition, mass 18 vibrates about an equilibrium position as shown by double headed arrow 52. During this period, the kinetic energy of the oscillating components is converted to heat energy by the rubbing of the reciprocating parts on the inside of the housing and by internal friction within the springs. Any slight further rightward motion of bolt 10 stores additional recoil energy in recoil spring 16 and positioning spring 28.

The following numerical example illustrates the principle of energy dissipation when mass 18 is released:

Assume that recoil 16 and positioning 28 springs have the following properties:

| Recoil Spring | Positioning Spring |
|---|---|
| Preload, $P = 25$ lb. | Preload, $P^1 = 25$ lb. |
| Load deflection rate, $R = 250$ lb./in. | Load deflection rate, $R^1 = 100$ lb./in. |
| Compression applied to recoil spring 16 before sear release, $S_1 = .7$ inch | |
| Load on recoil spring 16 at the end of compression $S_1$, $\bar{P} = 200$ lb. | |

Recoil spring 16 is compressed a distance $S_1$ equal to 0.7 inch before sear release. Thus, the load on recoil spring 16 is increased to $\bar{P}=200$ lb., and the load on positioning spring 28 remains at 25 lb. Immediately after sear release, recoil spring 16 expands by a distance $S_2$ and the loads on both springs become equal. The mathematical relationship in which this condition is described is given as follows:

$$\bar{P} - RS_2 = p^1 + R^1S_2 \quad (1)$$

$$200 - 250\,S_2 = 25 + 100\,S_2$$

$$\text{and } S_2 = .5 \text{ inch}$$

Resultant spring load, $P_R=\bar{P}-RS_2=200-250(0.5)=75$ lb. Therefore, immediately after sear release, the load on recoil spring 16 decreases from 200 lb. to 75 lb. The load on positioning spring 28 increases from 25 lb. to 75 lb.

The amount of energy dissipation can be calculated by either of the following two methods:

1. The amount of energy absorbed by the recoil spring 16 before the spring release is;

$$\text{Energy absorbed, } E_A = \frac{(P + \bar{P})}{2} S_1 = \frac{(25 + 200)}{(2)} (.7) = 78.75 \text{ in. lb.} \quad (2)$$

The amount of energy remaining in the mechanism immediately after sear release is:

$$\text{Energy remaining, } E_R = \frac{(P + P_R)}{2} S_1 = \frac{(25 + 75)}{2} (.7) = 35 \text{ in. lb.} \quad (3)$$

$$\text{Amount of energy dissipated, } E_D = E_A - E_R = 78.75 - 35 = 43.75 \text{ in. lb.} \quad (4)$$

2. The amount of energy dissipated is equal to the work performed by recoil spring 16 in expanding over the distance $S_2$ equal to 0.5 inch. The force F, acting over this distance varies and is equal to the difference in loads between recoil spring 16 and positioning spring 28.

$$F = \bar{P} - RD - P^1 - R^1D = 200 - 250\,D - 25 - 100\,D = 175 - 350\,D \quad (5)$$

Here, D varies from 0 to 0.5 inch. Integration of the above expression yields

Amount of energy dissipation, $$E_D = \int_0^{.5} (175 - 350\,D)\,dD = 43.75 \text{ in. lb.}$$

Figure 4:
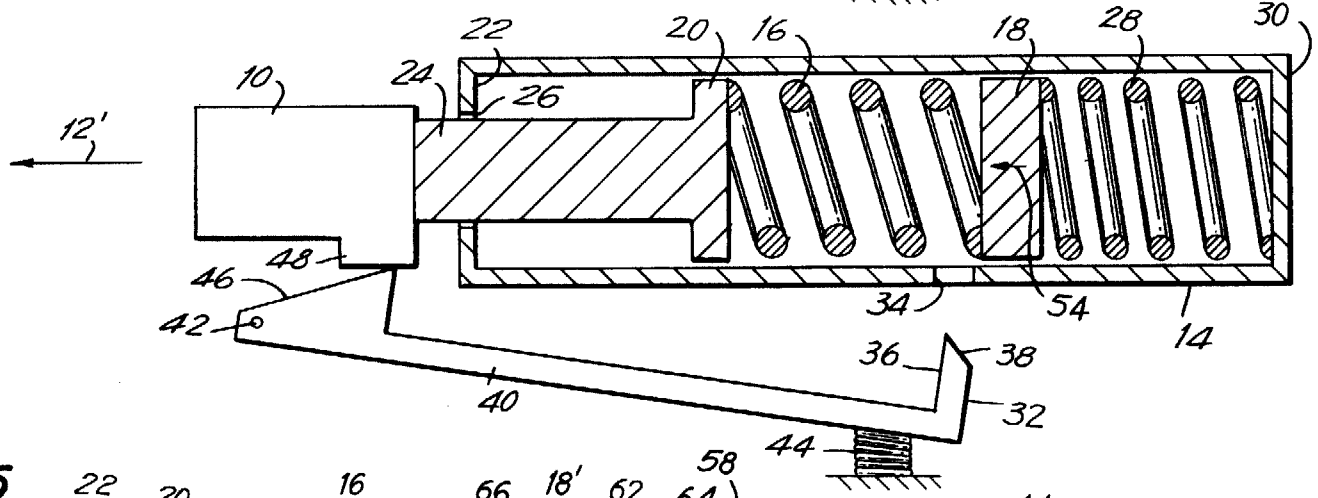

After all of the recoil energy has been stored and/or dissipated as previously described, recoil spring 16 and positioning spring 28 urge disc 20, plunger rod 24 and bolt 10 in a counter recoil direction indicated by an arrow 12'(FIG. 4). Mass 18 is urged in the direction of an arrow 54 during the counter recoil action and arrives at the equilibrium position shown in FIG. 1 as disc 20 comes into abutment with engagement shoulder 22. Cam surface 38 on sear 32 permits mass 18 to depress sear 32 against the urging of sear return spring 44 as necessary to permit mass 18 to return to its equilibrium position wherein sear 32 is urged into its latching position with latching surface 36 adjacent the right surface of mass 18.

Figure 5:
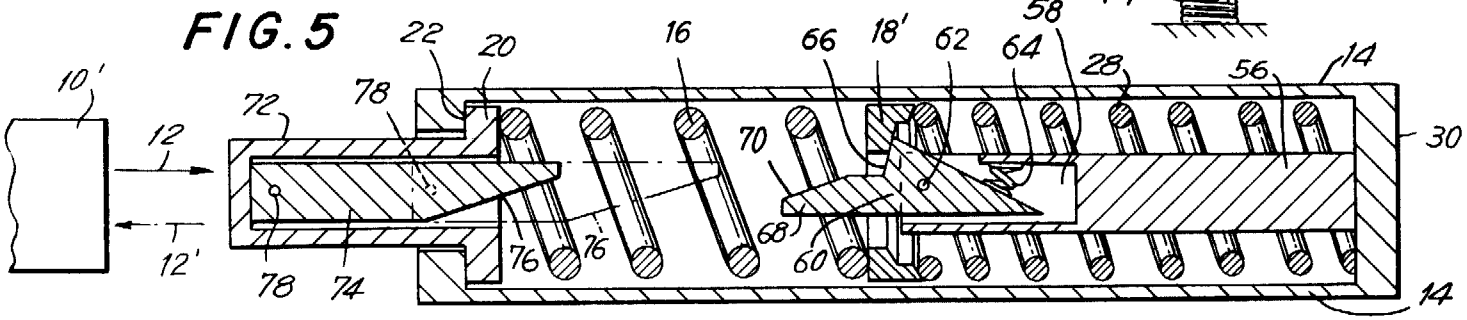
FIG. 5 is a cross sectional view of a dual rate firing mechanism according to a second embodiment of the invention.

Referring now to FIG. 5, there is shown a second embodiment of a dual rate firing mechanism. A recoil spring 16 and a positioning spring 28 are disposed on opposite sides of an annular mass 18'. A sear support 56 is centrally located on end abutment 30 and passes axially through the coils of positioning spring 28.

A cavity 58 in sear support 56 contains a sear 60 pivoted on a pivot 62 passing through sear support 56. A sear return spring 64 urges sear 60 in the clockwise direction. A sear latch surface 66 is dispose adjacent to the right surface of annular mass 18' and, in the position shown, prevents substantial rightward motion of annular mass 18' in FIG. 5. As in the preceding embodiment, the preload of recoil spring 16 and positioning spring 28 is such as to return annular mass 18' to the position shown in which its rightward surface is adjacent sear latch surface 66.

An actuating cam 68 on sear 60 includes a sloping cam surface 70.

A hollow plunger 72 includes a cam plunger 74 within it which has a rapid fire position shown in solid line and a slow fire position shown in dashed line. An actuating cam surface 76 on cam plunger 74 is effective to engage cam surface 70 of sear 60 during recoil when the cam plunger 74 is in the slow fire position shown in dashed line and to rotate sear 60 in the counterclockwise direction whereby sear latch surface 66 is rotated against the urging of sear return spring 64 to release annular mass 18 for energy absorption in a manner similar to that previously described.

When cam plunger 74 is in the rapid fire position shown in solid line, actuating cam surface 76 is not moved far enough in the recoil direction to engage cam surface 70 on sear 60 and thus normal energy storage and counter recoil action in recoil spring 16 is performed.

Cam plunger 74 is rigidly held in hollow plunger 72 by a locking pin 78 having first and second alternative positions. Adjusting the action for rapid fire or slow fire can be performed by sliding cam plunger 74 from one position to the other and retaining it in the selected position using locking pin 78. To facilitate sliding cam plunger 74 between positions, a longitudinal keyway (not shown) in the top portion of hollow plunger 72 may be provided to permit access to cam plunger 74 for the repositioning procedure.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A dual-rate firing mechanism for an automatic weapon of the type having a bolt driven in a recoil action and returned in a counter recoil action, comprising:

means for storing energy of said bolt during said recoil action and for returning at least part of the stored energy to said bolt during said counter recoil action, said means for storing energy including a recoil spring having first and second ends and a spring constant, means for applying kinetic energy of said bolt to said first end, and means for holding said second end stationary whereby said kinetic energy is transformed into spring potential energy in said recoil spring, said means for holding said second end stationary including a mass in abutment with said second end and a sear effective to substantially latch said mass against displacement while said kinetic energy is being transformed, means for selectively dissipating a portion of the stored energy during said said recoil action whereby less than substantially all of said stored energy remains for return to said bolt during said counter recoil action, said means for selectively dissipating including a positioning spring having a second spring constant effective to urge said mass in a direction opposite to the direction of applying said kinetic energy to said recoil spring, and means for releasing said mass from latching by said sear after a predetermined amount of said kinetic energy is transformed in said recoil spring whereby a portion of the stored kinetic energy is dissipated in moving said mass against said positioning spring.

2. A dual-rate firing mechanism according to claim 1; wherein said spring constant of said recoil spring and said second spring constant of said positioning spring are different.

3. A dual-rate firing mechanism for an automatic weapon comprising:

a housing having first and second ends;

an abutment at said first end of said housing;

a plunger protruding from said second end of said housing;

a bolt to which kinetic energy is imparted by firing said automatic weapon, said kinetic energy being effective to impact said bolt upon said plunger and to tend to drive said plunger into said housing;

a recoil spring in said housing having a first end in abutment with said plunger;

a positioning spring having a first end in contact with said abutment;

a second end of said recoil spring and a second end of said positioning spring being mutually opposed;

said recoil spring and said positioning spring being normally equally preloaded by the opposition therebetween;

a sear having first and second positions;

said sear being effective when in its first position to hold said second end of said recoil spring stationary during at least part of driving said plunger by said bolt whereby said kinetic energy of said bolt is transformed into spring potential energy of said recoil spring;

said sear being effective when in its second position to release said second end of said recoil spring whereby equilibrium between opposing forces in said recoil spring and said positioning spring is attained; and means for moving said sear from its first position to its second position at a predetermined time after said bolt begins driving said plunger.

4. A dual-rate firing mechanism according to claim 3; further comprising:

a free mass interposed between said second ends of said recoil and positioning springs; and said sear being effective in its first position to latch said mass in a substantially fixed position against urging by said recoil spring and effective in its second position to release said mass to permit it and said recoil and positioning springs to move toward equilibrium.

5. A dual-rate firing mechanism according to claim 4; wherein said mass is a disc interposed between said second ends of said recoil and positioning springs, said sear includes an abutment surface insertable from a perimeter of said disc in said first position to prevent substantial motion of said disc, cam means connected to said sear, actuating means moving with said bolt and effective to contact said cam means and move said sear from said first to said second position, and means for selectively adjusting said cam means for preventing contact between said actuating means and said cam means.

6. A dual-rate firing mechanism according to claim 4; further comprising:

said mass is an annular mass having a central opening therein;

at least said positioning spring is a coil spring;

a sear affixed at a first end to said abutment and passing axially within said positioning spring;

said sear being pivotally attached to a second end of said sear support;

said first and second positions of said sear being first and second pivotal positions;

means for normally urging said sear into said first pivotal position;

a cam surface on said sear protruding through said central opening;

an actuating cam disposed to move with said plunger;

an actuating surface on said actuating cam;

means for selectively axially affixing said actuating cam at first and second axial positions with respect to said plunger;

said actuating surface contacting said cam surface and being effective to pivot said sear to said second pivotal position at said predetermined time when said actuating cam is in its first axial position; and said actuating surface being incapable of contacting said cam surface when said actuating cam is in its second axial position.

* * * * *